US007134948B2

(12) United States Patent
Tseng et al.

(10) Patent No.: US 7,134,948 B2
(45) Date of Patent: Nov. 14, 2006

(54) MAGNETICALLY SECURED RETAINING RING

(75) Inventors: Ming-Kuei Tseng, San Jose, CA (US); Ralph M. Wadensweiler, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/316,413

(22) Filed: Dec. 21, 2005

(65) Prior Publication Data

US 2006/0160474 A1 Jul. 20, 2006

Related U.S. Application Data

(60) Provisional application No. 60/644,838, filed on Jan. 15, 2005.

(51) Int. Cl.
*B24B 5/00* (2006.01)

(52) U.S. Cl. ..... 451/288; 451/28; 451/398

(58) Field of Classification Search ..... 451/285–289, 451/28, 41, 397, 398; 438/691–693
See application file for complete search history.

(56) References Cited

U.S. PATENT DOCUMENTS

| | | | | |
|---|---|---|---|---|
| 5,738,574 | A | 4/1998 | Tolles et al. | |
| 6,036,587 | A | 3/2000 | Tolles et al. | |
| 6,059,638 | A | 5/2000 | Crevasse et al. | |
| 6,121,142 | A | 9/2000 | Crevasse et al. | |
| 6,251,215 | B1 | 6/2001 | Zuniga et al. | |
| 6,282,053 | B1 | 8/2001 | MacLeod et al. | |
| 6,354,928 | B1 | 3/2002 | Crevasse et al. | |
| 6,716,086 | B1 | 4/2004 | Tobin | |
| 2005/0095964 | A1 * | 5/2005 | Hengel, Jr. | 451/285 |
| 2005/0211377 | A1 | 9/2005 | Chen et al. | |

* cited by examiner

*Primary Examiner*—Dung Van Nguyen
(74) *Attorney, Agent, or Firm*—Fish & Richardson

(57) ABSTRACT

A retaining ring having a bottom portion that is removable from the ring's upper portion is described. The upper and lower portions of the retaining ring include one or more magnetic bodies and/or one or more bodies formed of a material that is attracted to magnets.

19 Claims, 8 Drawing Sheets

MAGNETICALLY SECURED RETAINING RING

CROSS-REFERENCE TO RELATED APPLICATIONS

This application claims priority to U.S. Provisional Application Ser. No. 60/644,838, filed on Jan. 15, 2005. The disclosure of the prior application is considered part of and is incorporated by reference in the disclosure of this application.

BACKGROUND

This invention relates to chemical mechanical polishing of substrates.

An integrated circuit is typically formed on a substrate by the sequential deposition of conductive, semiconductive or insulative layers on a silicon substrate. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head of a CMP apparatus. The exposed surface of the substrate is placed against a rotating polishing disk pad or belt pad. The polishing pad can be either a "standard" pad or a fixed-abrasive pad. A standard pad has a durable roughened surface, whereas a fixed-abrasive pad has abrasive particles held in a containment media. The carrier head provides a controllable load on the substrate to push it against the polishing pad. A polishing liquid, such as a slurring with abrasive particles, is supplied to the surface of the polishing pad.

SUMMARY

A retaining ring having a bottom portion that is removable from the ring's upper portion is described. The two or more portions of the retaining ring are secured together magnetically.

In one aspect, the invention is directed to a retaining ring. The retaining ring has a substantially annual upper portion having an upper surface configured to be attached to a carrier head and a substantially annular lower portion having an upper surface configured to contact a lower surface of the upper portion. At least one of the upper and lower portions includes a magnetic material and the other of the upper and lower portions includes a material attracted to the magnetic material.

Implementations of the invention may include one or more of the following features. The upper portion can have one or more alignment members, such as alignment pins, extending from a lower surface. The lower portion can have one or more corresponding receiving recesses for the alignment members. The alignment pins can alternatively be in the lower portion and the recesses in the upper portion. The upper portion can include magnetic stainless steel, such as ferritic stainless steel. The magnetic material can be a permanent magnet or a material that can be magnetized. The lower portion can be less rigid than the upper portion. The lower portion can be formed of PPS. Magnets can be embedded in the PPS.

In another aspect, the invention is directed to a method of making a retaining ring. The method includes forming a substantially annular lower portion of a retaining ring. One or more bodies of magnetic material are embedded in the lower portion. A substantially annular upper portion of a retaining ring is formed such that at least a lower surface of the upper portion includes a material that is capable of being attracted to the magnetic material.

The method can further include aligning the lower portion with the upper portion such that alignment members align with receiving recesses for the alignment members. The magnetic material in one of the portions can be electromagnetic material that is activated. The upper portion can be aligned with the carrier head so that the lower surface of the upper portion is perpendicular to a central axis of the carrier head.

In yet another aspect, the invention is directed to a method of making a retaining ring. The method includes forming a substantially annular lower portion of a retaining ring. A material that is capable of being attracted to a magnetic material is bonded to an upper surface of the lower portion. A substantially annular upper portion of the retaining ring is formed such that one or more bodies of magnetic material are embedded in the upper portion.

In another aspect, the invention is directed to a method of attaching a retaining ring to a carrier head. The method includes fastening an upper portion of a retaining ring to a carrier head, wherein the upper portion includes a material that is capable of being attracted to a magnetic material in a lower surface. A lower portion of the retaining ring is brought into contact with the upper portion, wherein one or more bodies of magnetic material in the lower portion hold the upper and lower portions together.

In yet another aspect, the invention is directed to a system for chemical mechanical polishing of a substrate. The system includes a carrier head and a retaining ring secured to the carrier head. The retaining ring includes a substantially annular upper portion configured to be attached to the carrier head and a substantially annular lower portion having an upper surface configured to contact a lower surface of the upper portion. At least one of the upper and lower portions includes a magnetic material and the other of the upper and lower portions includes a material attracted to the magnetic material.

Potential advantages of the invention include one or more of the following. The wearable portion of the retaining ring can be easily replaced. In particular, the lower portion can be removed and replaced separately from the upper portion of the retaining ring. Time required for servicing the carrier-head can be reduced. The upper portion of the retaining ring may be reused. Because only the lower portion may need to be replaced, it may be possible to only replace the worn portions of the retaining ring, rather than replacing the entire retaining ring.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

A retaining ring 100 is a generally an annular ring that can be secured to a carrier head of a CMP apparatus. A suitable CMP apparatus is described in U.S. Pat. No. 5,738,574 and a suitable carrier head is described in U.S. Pat. No. 6,251,215, and in U.S. Publication No. 2005-0211377 A1, the entire disclosures of which are incorporated herein by reference. The retaining ring 100 fits into a loadcup for positioning, centering, and holding the substrate at a transfer station of the CMP apparatus. A suitable loadcup is described in U.S. Pat. No. 6,716,086, the entire disclosure of which is incorporated by reference.

Figure 1:
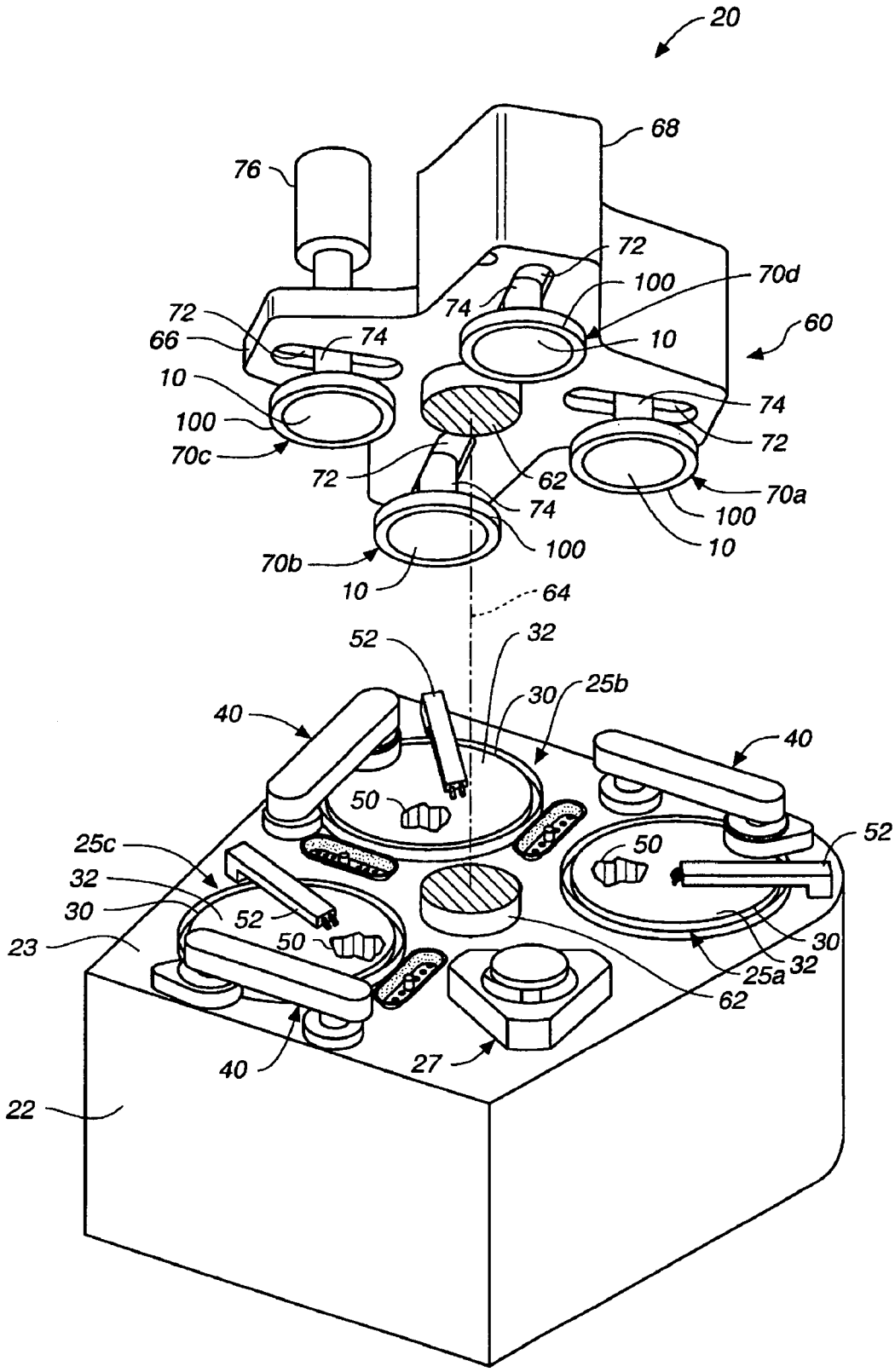
FIG. 1 is an exploded perspective view of a chemical mechanical polishing apparatus.

Referring to FIG. 1, one or more substrates 10 will be polished by a chemical mechanical polishing (CMP) apparatus 20.

Each polishing station 25*a*–25*c* includes a rotatable platen 30 on which is placed a polishing pad 32. If substrate 10 is an eight-inch (200 millimeter) or twelve-inch (300 millimeter) diameter disk, then platen 30 and polishing pad 32 will be about twenty or thirty inches in diameter, respectively. Platen 30 may be connected to a platen drive motor (not shown) located inside machine base 22. For most polishing processes, the platen drive motor rotates platen 30 at thirty to two-hundred revolutions per minute, although lower or higher rotational speeds may be used. Each polishing station 25*a*–25*c* may further include an associated pad conditioner apparatus 40 to maintain the abrasive condition of the polishing pad.

A polishing liquid 50 may be supplied to the surface of polishing pad 32 by a combined slurry/rinse arm 52. The polishing liquid 50 may include abrasive particles (e.g., silicon dioxide for oxide polishing). Typically, sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

A rotatable multi-head carousel 60, including a carousel support plate 66 and a cover 68, is positioned above lower machine base 22. Carousel support plate 66 is supported by a center post 62 and rotated thereon about a carousel axis 64 by a carousel motor assembly located within machine base 22. Multi-head carousel 60 includes four carrier head systems 70*a*, 70*b*, 70*c*, and 70*d* mounted on carousel support plate 66 at equal angular intervals about carousel axis 64. Three of the carrier head systems receive and hold substrates and polish them by pressing them against the polishing pads of polishing stations 25*a*–25*c*. One of the carrier head systems receives a substrate from and delivers the substrate to transfer station 27. The carousel motor may orbit carrier head systems 70*a*–70*d*, and the substrates attached thereto, about carousel axis 64 between the polishing stations and the transfer station.

Each carrier head system 70*a*–70*d* includes a polishing or carrier head 100. Each carrier head 100 independently rotates about its own axis, and independently laterally oscillates in a radial slot 72 formed in carousel support plate 66. A carrier drive shaft 74 extends through slot 72 to connect a carrier head rotation motor 76 (shown by the removal of one-quarter of cover 68) to carrier head 100. There is one carrier drive shaft and motor for each head. Each motor and drive shaft may be supported on a slider (not shown) which can be linearly driven along the slot by a radial drive motor to laterally oscillate the carrier head.

During actual polishing, three of the carrier heads, e.g., those of carrier head systems 70*a*–70*c*, are positioned at and above respective polishing stations 25*a*–25*c*. Each carrier head 100 lowers a substrate into contact with a polishing pad 32. Generally, carrier head 100 holds the substrate in position against the polishing pad and distributes a force across the back surface of the substrate. The carrier head also transfers torque from the drive shaft to the substrate.

Figure 2:
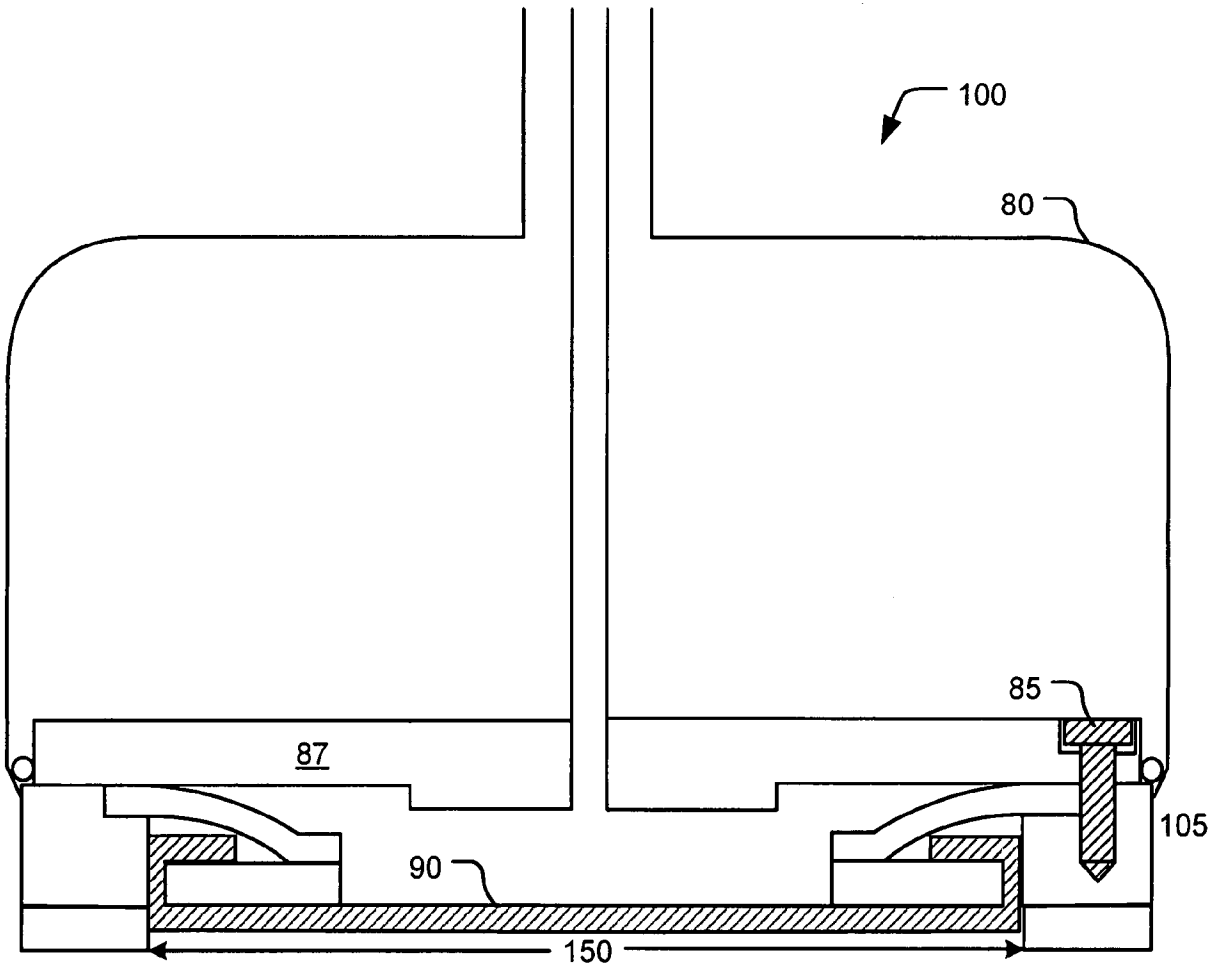
FIG. 2 is a cross-sectional view of a carrier head.
Figure 4:
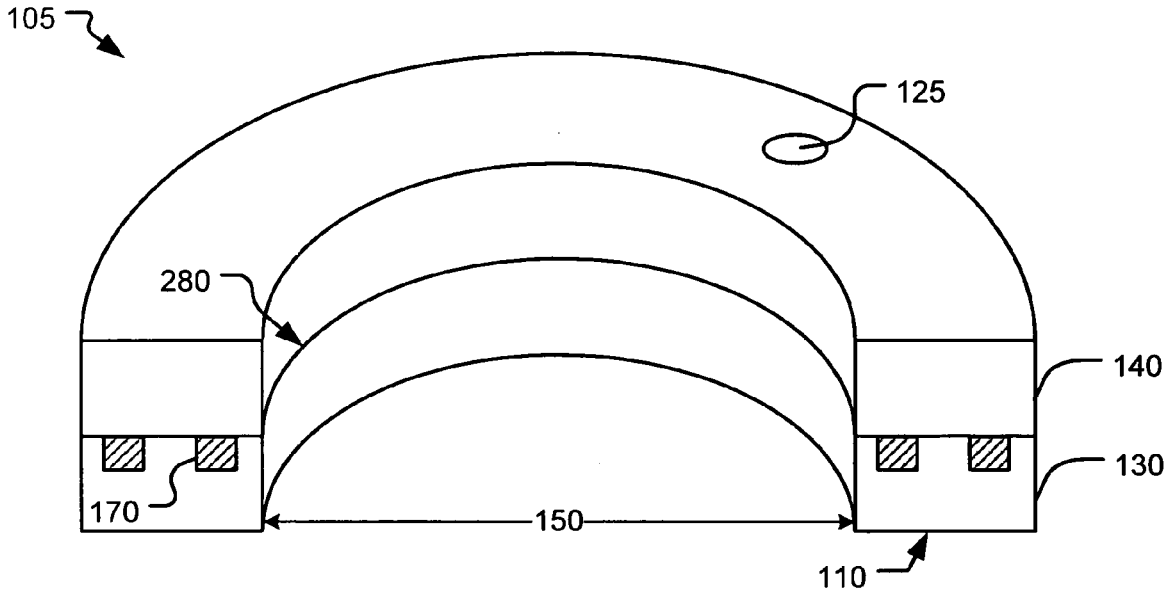
FIG. 4 is a cross-sectional view of the retaining ring.

Referring to FIG. 2, the carrier head 100 includes a housing 80 and a base 87 attached to a retaining ring 105. The retaining ring 105 can be held to the base 87, such as by using a releasable fastening mechanism 85, for example, a screw, a bolt, or a clamp. The retaining ring can include a recess or aperture 125 for receiving the fastening mechanism 85 (as shown in FIG. 4). Within the retaining ring 105 is a substrate receiving recess 150, which retains the substrate during polishing. A membrane 90 within the substrate receiving recess 150 contacts the back of the substrate during polishing.

Figure 3:
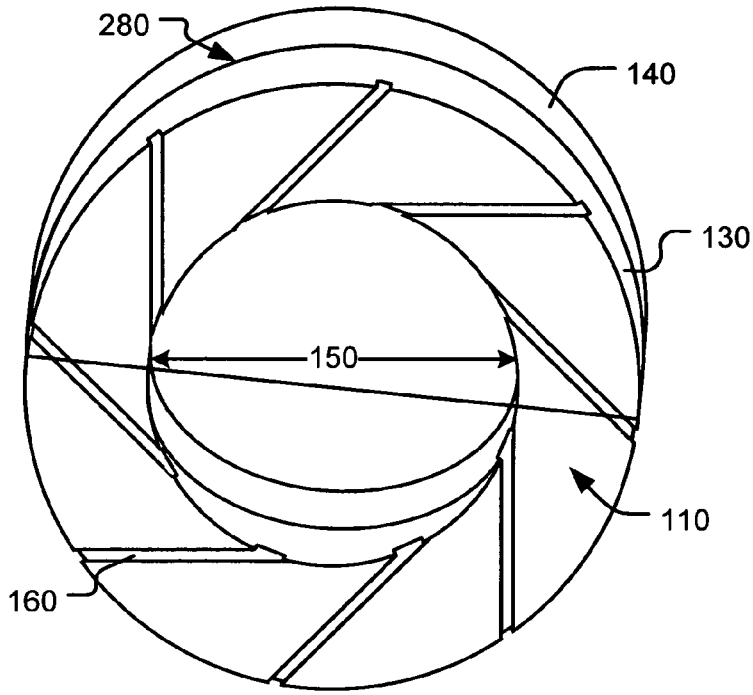
FIG. 3 is a perspective view of the retaining ring.

Referring to FIGS. 3 and 4, a retaining ring 105 has two parts, an upper portion 140 and a lower portion 130. A lower surface of the upper portion 140 contacts a top surface 280 of the lower portion 130. The surfaces of the upper and lower portions can be substantially free of any adhesive materials. The upper and lower portion are constructed of materials that can secure the two portions together to form the retaining ring 105.

The body of the lower portion 130 is formed of a material which is chemically inert to the CMP process. In addition, the lower portion 130 should be sufficiently elastic that contact of the substrate edge against the retaining ring does not cause the substrate to chip or crack. However, the lower portion should not be so elastic as to extrude into the substrate receiving recess 150 when the carrier head puts downward pressure on the retaining ring 105. The lower portion 130 of the retaining ring should also be durable and have a low wear rate, although it is acceptable for the lower portion 130 to wear away. For example, the lower portion 130 of the retaining ring can be made of a plastic, such as polyphenylene sulfide (PPS), polyethylene terephthalate. (PET), polyetheretherketone (PEEK), polybutylene terephthalate (PBT), polytetrafluoroethylene (PTFE), polybenzimidazole (PBI), polyetherimide (PEI), polyamide-imide (PAI) or a composite material.

The lower portion 130 has a bottom surface 110 that contacts a polishing surface. The bottom surface 110 can be flat, or it can include grooves 160 that allow a polishing liquid to flow into the recess 150 from outside the retaining ring 105 during polishing.

Figure 5:
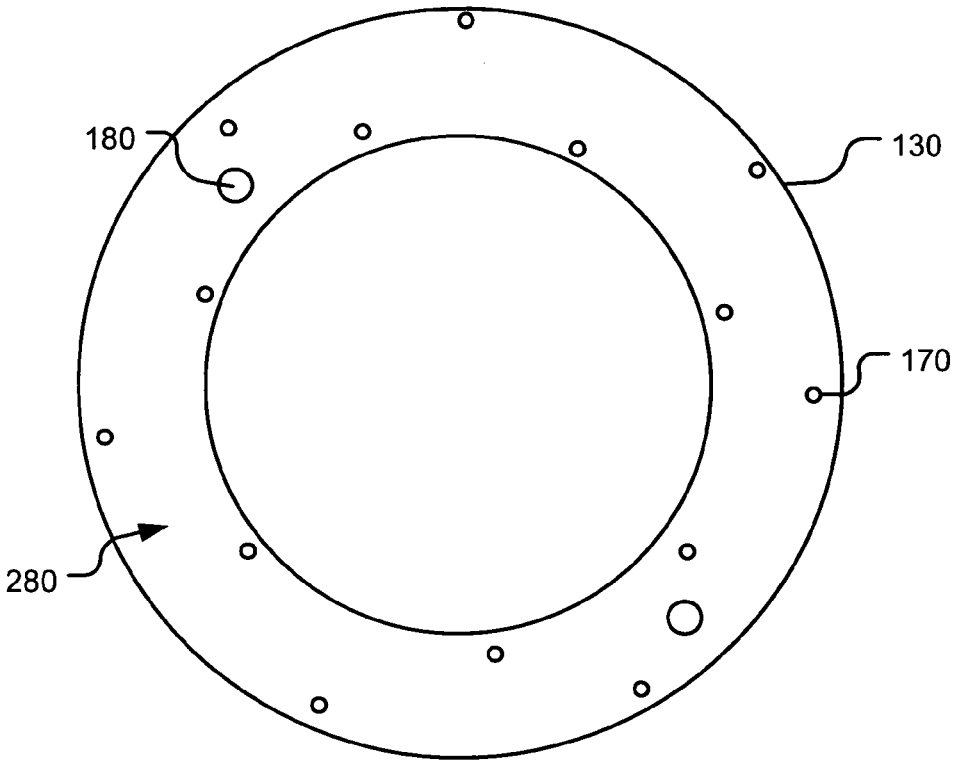
FIG. 5 is a plan view of a lower portion of the retaining ring.

Referring to FIG. 5, the lower portion 130 of the retaining ring 105 can include magnets 170 positioned at or near the top surface 280 of the lower portion 130. The magnets 170 can be formed of a metal or ceramic material. Such materials can include iron or a rare earth metal, such as magnets in the families of neodymium, neodymium-iron-boron, samarium-cobalt, aluminum-nickel-cobalt, and ceramics, such as hard ferrite, strontium and barium ferrite. The magnets can be permanently magnetic, e.g., ferromagnetic, or can be electromagnetic. Recesses can be formed in the top surface of the lower portion 130 and magnets 170 can be secured in the recesses, such as by press fitting the magnets or bonding the magnets into the recesses. In one implementation, the magnets 170 are disk shaped. In another implementation, the magnets 170 are rectangular. In some implementations, the magnets 170 are each approximately the same size. In other implementations, the magnets 170 have different sizes from one another. In one implementation, the magnets are exposed to the environment.

Figure 6:
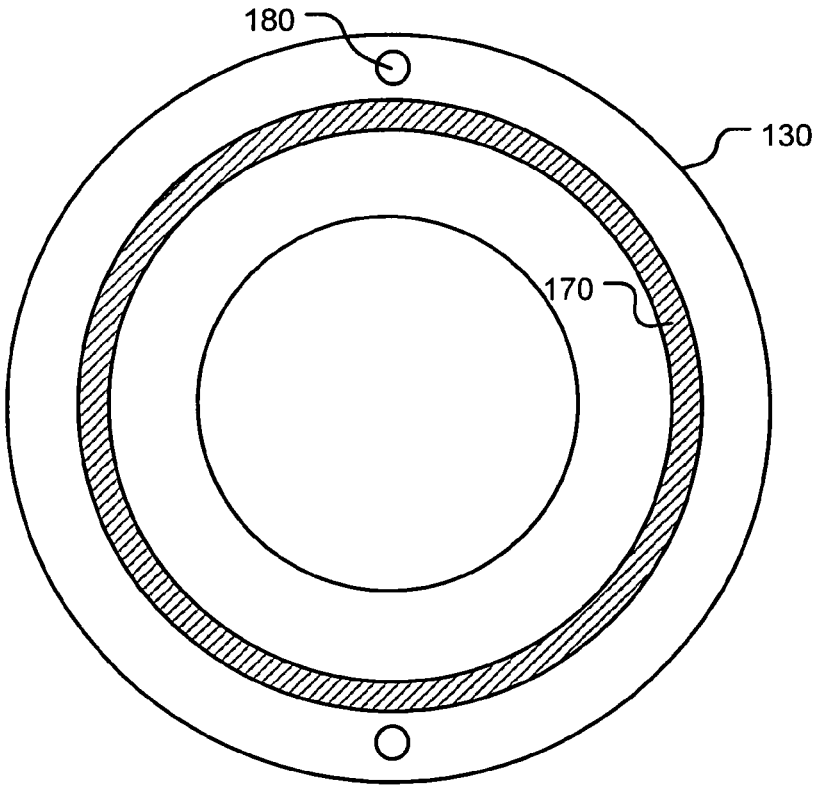
FIG. 6 is a plan view of an alternative implementation of the lower portion of the retaining ring.

Referring to FIG. 6, in one implementation, the recesses are in the form of one or more concentric grooves. Each groove can be filled with an annular magnet 170.

In addition to the magnets 170, the upper surface also includes one or more alignment holes, such as dowel pin holes 180 for receiving dowels. In a retaining ring with multiple dowel pin holes 180, the dowel pin holes 180 can be spaced at equal angular intervals around the retaining ring.

Figure 7:
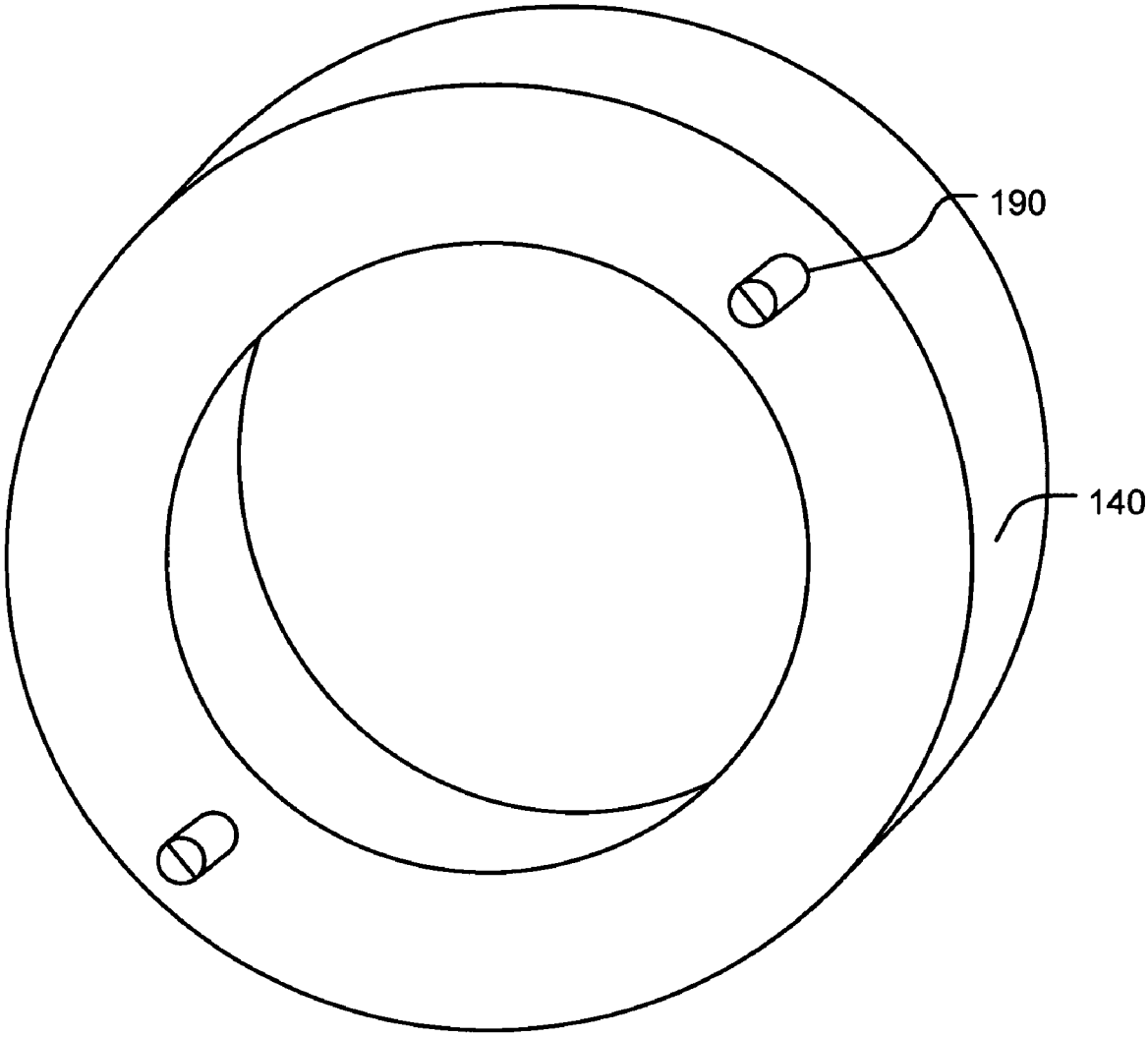
FIG. 7 is a bottom view of an upper portion of the retaining ring.

Referring to FIG. 7, the upper portion 140 is stiff and formed from, or includes portions that are formed from, a material that is sufficiently attracted to magnets 170 so as to hold the lower portion 130. Thus, the magnets 170 hold the lower portion 130 securely to the upper portion 140. The upper portion 140 can include a material, e.g., a metal that is attracted by magnets 170, such as iron, nickel or alloys of such. Suitable materials for the upper portion 140 can include metals, such as ferritic stainless steel, for example, series 400 stainless steel. In one implementation, only a lower section of the upper portion 140 includes material that is attractive to magnets.

The upper portion 140 includes dowel pins 190. The dowel pins can be formed from the same material as the upper portion 140. The dowel pins 190 can be integrally formed with the upper portion or secured to the upper portion 140 after the main body of the upper portion 140 is formed. The dowel pins 190 are located on the upper portion 140 such that the dowel pins 190 align with the dowel pin holes 180 formed in the top surface of the lower portion 130. The dowel pins 190 align the upper and lower portions 130, 140 when the portions are brought together and maintain the alignment of the two portions when shear forces act against the retaining ring 105 during polishing.

A top surface 280 of the upper portion 140 can include holes for receiving fasteners, such as screws or bolts, for fastening the upper portion 140 to a carrier head.

Figure 8:
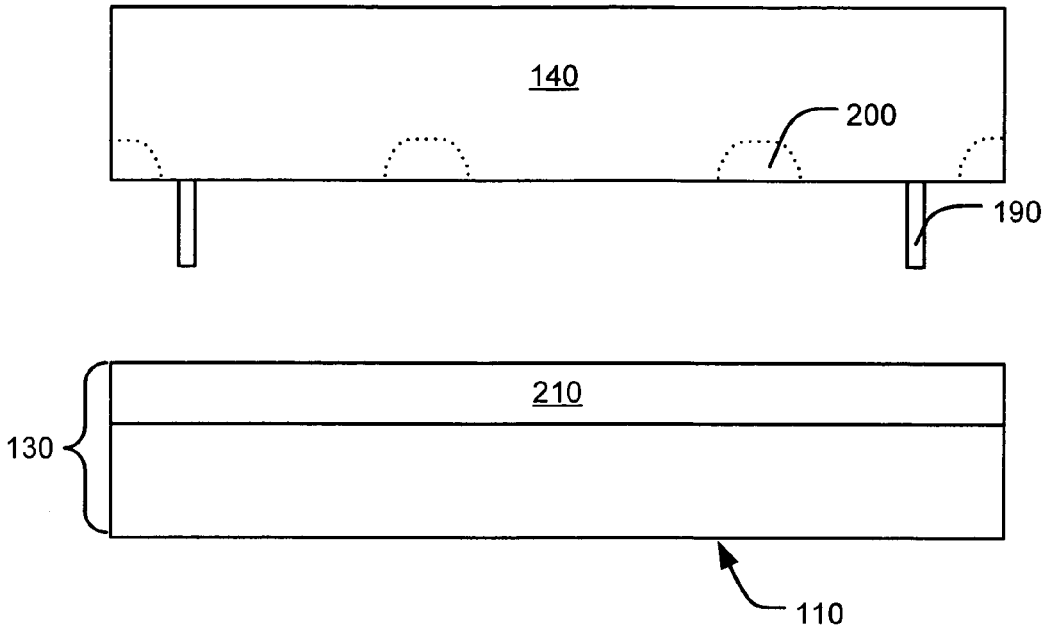
FIG. 8 is an exploded side view of one implementation of the retaining ring.

Referring to FIG. 8, in an alternative implementation, the upper portion 140 is formed of a substantially non-magnetic material and has a magnetic portion 200 embedded therein (embedded magnetic portions 200 are shown in phantom). The magnetic portion 200 can be made up of one or more magnetic bodies that are spaced about the ring. In one implementation, the magnetic portion 200 is formed in a concentric circular area of the bottom of the upper portion 140. In another implementation, the magnetic portion 200 forms the entire bottom surface of the upper portion 140.

The lower portion 130 can have an attractive portion 210, that is, a portion including a material that is attracted to a magnet, formed along the upper surface. The attractive portion 210 can be formed as a layer or individual bodies of magnetic material or magnetically attracted material. The attractive material and the elastic material are secured together, such as by press fitting or adhesively bonding the portions together.

Figure 9:
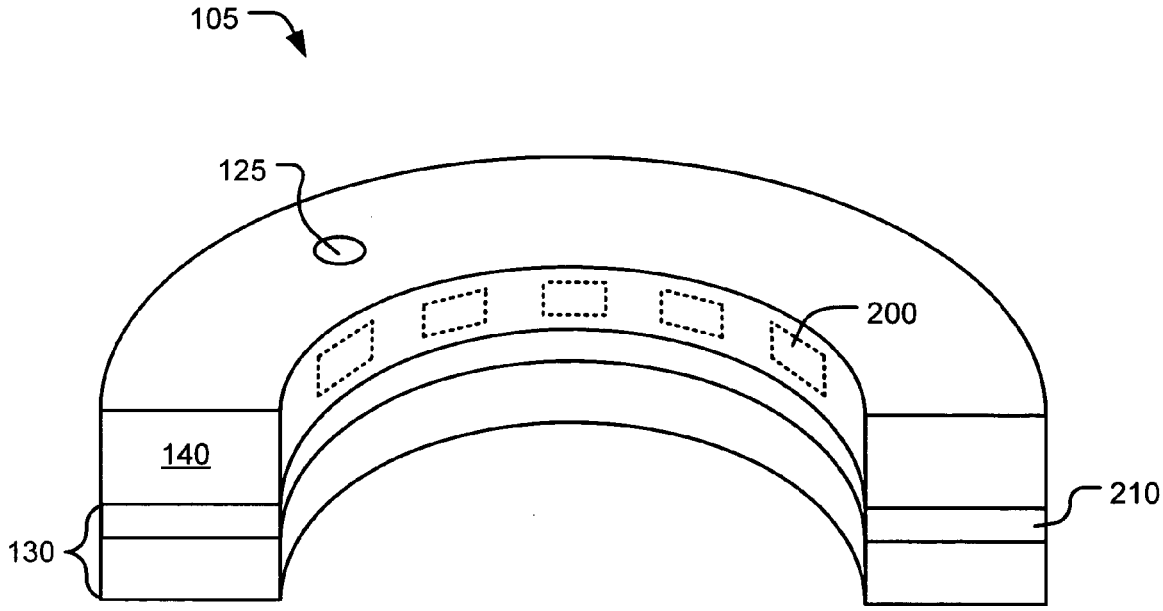
FIG. 9 is a cross-sectional view of a retaining ring with embedded magnets.

Referring to FIG. 9, the magnet portion 200 can be embedded in a portion of the retaining ring 105 (embedded magnetic portions 200 are shown in phantom). The other portion of the retaining ring 105 has an attractive portion 210 formed thereon or integrated therein.

Forming the ring to have embedded magnetic portions can include forming an annular body and forming one or more recesses into the body, such as by drilling. The magnets are then placed in the recesses. The magnets can be secured in the recesses, such as by forming a plug for any open portion of the recess, with a material that can be cured after application, such as a bonding material. The recesses are formed to a depth within the body such that a sufficient amount of material remains at the base of the recess, preventing the magnet in the recess from causing material at the base of the recess from deforming or bulging when the magnet is in the vicinity of a material attracted to the magnet. At the same time, enough material is removed so that the magnet's magnetic strength is not diminished by the thickness of the material. Additionally, if magnets are embedded in both the upper portion 40 and the lower portion 30, the magnets are aligned so that magnets attract one another rather than repel one another when the two portions are brought together, i.e., the north poles of the magnets in one portion face the south poles of the magnets in the other portion.

A retaining ring is prepared for use as follows. The two portions of the retaining ring 105 are formed with the appropriate magnetic and attractive portions, as described above. The lower portion 130 is then aligned with the upper portion 140 such that the dowel pins align with the dowels holes. This aligns the magnets so that the upper and lower portions 140, 130 are attracted together, rather than repelled. The lower portion 130 is brought into contact with the upper portion 140 and the two portions are secured together magnetically. The upper portion 140 is attached to a carrier head, such as by screwing the upper portion 140 to the carrier head. Alternatively, the upper portion 140 is attached to the carrier head before the lower portion 130 of the ring is secured to the upper portion 140. If the magnets in the upper or lower portions are permanent magnets, the magnets 170 hold the retaining ring 105 together.

Figure 10:
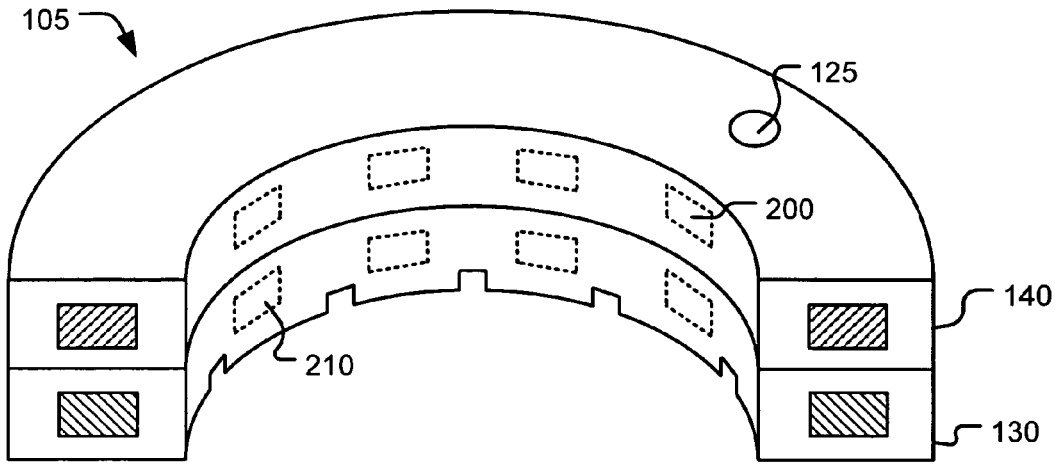
FIGS. 10–13 show alternative implementations of the invention.
Figure 11:
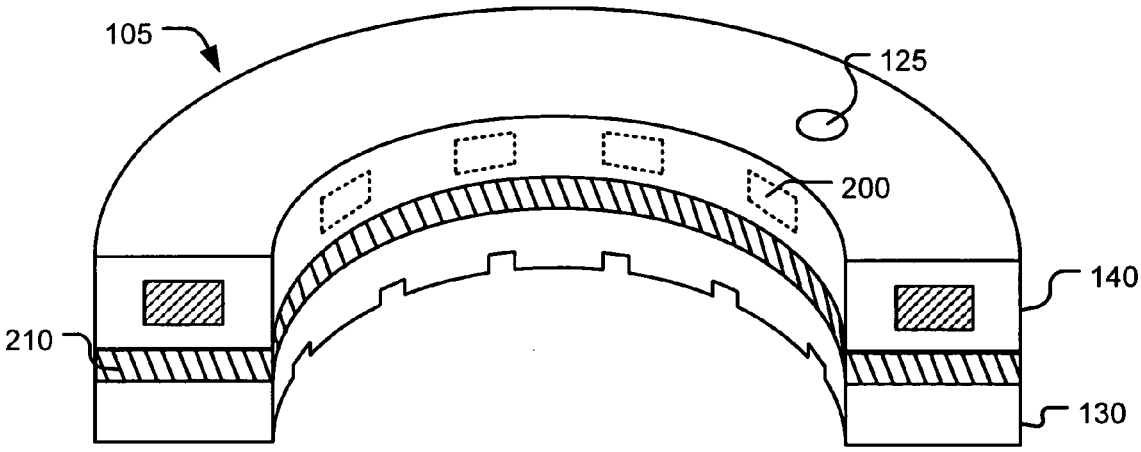
Figure 12:
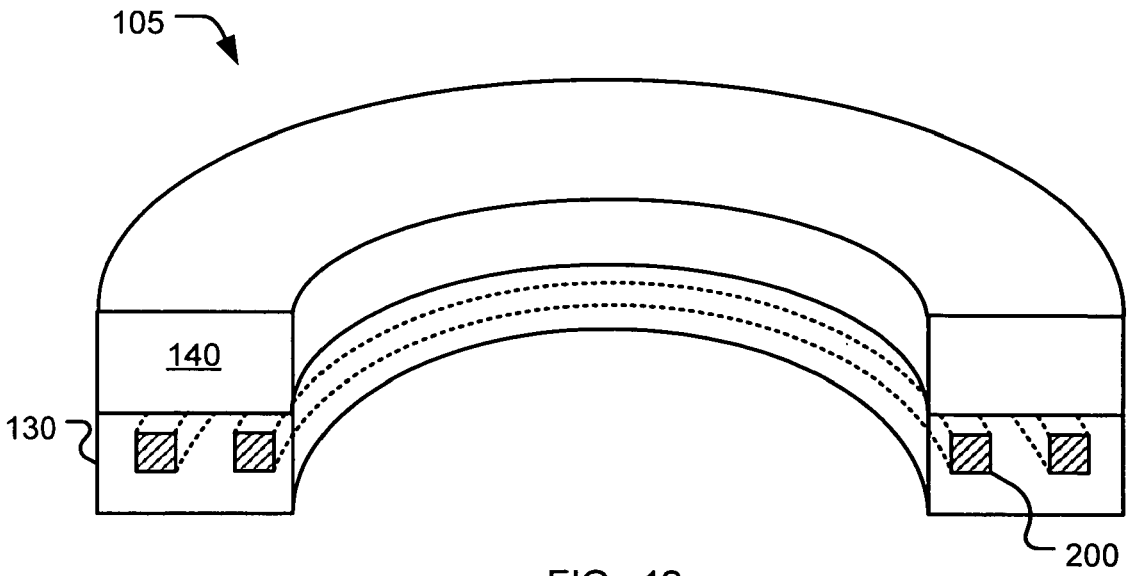
Figure 13:
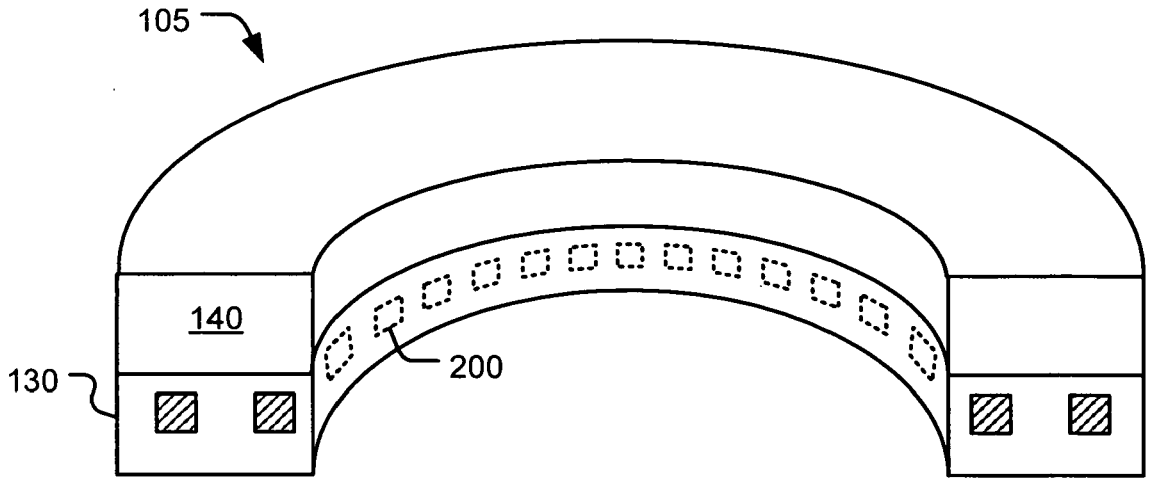

Referring to FIGS. 10–13, alternative implementations of the retaining ring include various configurations for the annular bodies and magnets. Referring to FIG. 10, magnetic portions 200 are embedded in the upper portion 140 and attractive portions 210 are embedded in the lower portion 130 of the retaining ring 105 (embedded magnetic portions 200 and attractive portions are shown in phantom). The magnetic portions 200 and attractive portions 210 in the upper and lower portions 140, 130 are aligned to allow the portions to be attracted to one another. Referring to FIG. 11, magnetic portions 200 are embedded in the upper portion 140 and an attractive portion 210 is secured to the lower portion 130 (embedded magnetic portions 200 are shown in phantom). The location of the magnetic portions 200 and attractive portions 210 can be reversed from the locates shown in FIGS. 10–11. Referring to FIG. 12, the upper portion 140 is formed from a material that is attracted to magnets and the lower portion 130 has annular magnet portions 200 embedded therein so that the magnet portions 200 are adjacent to an upper surface of the lower portion 130 (embedded magnetic portions 200 are shown in phantom). Referring to FIG. 13, the retaining ring 105 is similar in construction to the retaining ring shown in FIG. 12, however, multiple non-annular magnetic portions 200 are embedded in the lower portion 130 (embedded magnetic portions 200 are shown in phantom).

In some implementations, the magnets (or attractive portions) are capable of being switched on and off. To form the retaining ring, the magnets are activated, such as by supplying power to a wire wrapped around a suitable metal. In this implementation, a power supply is in electrical communication with the magnetic portion of the retaining ring.

The retaining ring can then be used in a polishing process for substrates. As the retaining ring 105 is used, the bottom surface 110 of the retaining ring 105 wears away. The lower portion 130 can be replaced by removing the lower portion 130 from the upper portion 140, such as by pulling the lower portion 130 away from the upper portion 140. A new lower portion 130 can replace the worn lower portion 140 and the carrier head is again ready for polishing substrates.

The above described retaining ring has an easily replaceable lower portion. When the lower portion has worn so that it is no longer suitable for polishing substrates (the lower portion may be sufficiently unsuitable for polishing when the bottom surface has worn less than 0.1 inches), the worn portion is removed and replaced. The above described retaining ring embodiments obviate the need to remove the upper portion from the carrier head. When the entire retaining ring is removed from the carrier head, replacing the retaining ring can require ensuring that a bottom surface of the retaining ring is perpendicular to a center axis of the carrier head. With the retaining ring described herein, this alignment only need be ensured the first time the upper portion of the retaining ring is attached to the carrier head. Because the upper portion 140 need not be removed to replace the lower portion 130, realignment of the retaining ring 105 is not necessary. This can reduce the amount of time required for replacement, so that the carrier head has less downtime. Further, replacement of the lower portion 130 may not require an operator who is skilled at attaching a retaining ring 105 so that the retaining ring is parallel to the polishing surface. Embedding magnets in a non-magnetic material can allow one or both of the bodies to be formed of a material that offers better chemical resistance to the polishing environment than the magnet material.

In addition, because only the lower portion 130 of the retaining ring 105 needs to be removed from the carrier head, the materials required for replacing the wearable portion are less than when the entire retaining ring is replaced. The upper portion 140 does not need replacing.

A number of embodiments of the invention have been described. Nevertheless, it will be understood that various modifications may be made without departing from the spirit and scope of the invention. For example, the dowel pins can be formed in the lower portion while the dowel pin holes are formed in the upper portion. As another example, the magnets can be formed in the upper portion, and the lower portion can include a material that is attracted to the magnets. Accordingly, other embodiments are within the scope of the following claims.

What is claimed is:

1. A retaining ring, comprising:

a substantially annual upper portion having an upper surface configured to be attached to a carrier head;

a substantially annular lower portion having an upper surface configured to contact a lower surface of the upper portion;

wherein at least one of the upper portion or the lower portion includes a magnetic material; and the other of the upper portion or the lower portion includes a material attracted to the magnetic material and is sufficiently attracted to the magnetic material to hold the upper portion and lower portion together.

2. The retaining ring of claim 1, wherein:

the upper portion includes one or more alignment members extending from the lower surface; and the lower portion includes one or more corresponding receiving recesses for the one or more alignment members.

3. The retaining ring of claim 1, wherein:

the lower portion includes one or more alignment members extending from the lower surface; and the upper portion includes one or more corresponding receiving recesses for the one or more alignment members.

4. The retaining ring of claim 1, wherein the upper portion includes ferritic stainless steel.

5. The retaining ring of claim 1, wherein the magnetic material is a permanent magnet.

6. The retaining ring of claim 1, wherein the lower portion is less rigid than the upper portion.

7. The retaining ring of claim 1, wherein the lower portion is formed from PPS.

8. The retaining ring of claim 7, wherein the lower portion has magnets embedded in the PPS.

9. A method of forming a retaining ring, comprising:

forming a substantially annular lower portion of the retaining ring;

embedding one or more bodies of magnetic material in the lower portion; and forming a substantially annular upper portion of the retaining ring such that at least a lower subportion of the upper portion includes a material that is capable of being attracted to the magnetic material when the upper portion is brought into contact with the lower portion.

10. The method of claim 9, wherein forming the upper portion includes forming the upper portion to include ferritic stainless steel.

11. The method of claim 9, wherein forming the upper portion includes forming one or more alignment members in the lower surface of the upper portion.

12. The method of claim 11, wherein forming the lower portion includes forming in an upper surface one or more corresponding receiving recesses for the one or more alignment members in the upper portion.

13. The method of claim 9, wherein forming the lower portion includes forming the lower portion from PPS.

14. The method of claim 9, wherein embedding the one or more portions of magnetic material includes embedding permanent magnets into an upper surface of the lower portion.

15. A method of forming a retaining ring, comprising:

forming a substantially annular upper portion of the retaining ring such that one or more bodies of magnetic material are embedded in the upper portion;

forming a substantially annular lower portion of the retaining ring; and bonding a material that is capable of being attracted to the magnetic material to an upper surface of the lower portion such that the magnetic material in the upper portion is capable of holding the lower portion and the upper portion together.

16. A method of attaching a retaining ring to a carrier head, comprising:

fastening an upper portion of the retaining ring to the carrier head, wherein the upper portion includes a material that is capable of being attracted to a magnetic material in a lower portion; and bringing the lower portion of the retaining ring into contact with the upper portion, wherein one or more bodies of the magnetic material in the lower portion hold the upper portion and lower portion together.

17. The method of claim 16, further comprising aligning the lower portion to the upper portion such that alignment members in the upper portion align with receiving recesses in the lower portion.

18. The method of claim 16, further comprising, prior to bringing the lower portion into contact with the upper portion, aligning the upper portion with the carrier head so that the lower surface is perpendicular to a central axis of the carrier head.

19. A system for chemical mechanical polishing of a substrate, comprising:

a carrier head; and a retaining ring secured to the carrier head, comprising:

a substantially annual upper portion having an upper surface configured to be attached to the carrier head;

a substantially annular lower portion having an upper surface configured to contact a lower surface of the upper portion;

wherein at least one of the upper portion or the lower portion includes a magnetic material; and the other of the upper portion or the lower portion includes a material attracted to the magnetic material and is sufficiently attracted to the magnetic material to hold the upper and lower portions together.

* * * * *